US009464829B2

(12) United States Patent
Ue et al.

(10) Patent No.: US 9,464,829 B2
(45) Date of Patent: Oct. 11, 2016

(54) AIR-CONDITIONING APPARATUS

(75) Inventors: Junichi Ue, Tokyo (JP); Osamu Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 553 days.

(21) Appl. No.: 13/996,057

(22) PCT Filed: Feb. 7, 2011

(86) PCT No.: PCT/JP2011/000654

§ 371 (c)(1),
(2), (4) Date: Jun. 20, 2013

(87) PCT Pub. No.: WO2012/107947

PCT Pub. Date: Aug. 16, 2012

(65) Prior Publication Data

US 2013/0269379 A1 Oct. 17, 2013

(51) Int. Cl.

| | |
|---|---|
| ***F25B 29/00*** | (2006.01) |
| ***F24F 1/32*** | (2011.01) |
| ***F24F 3/06*** | (2006.01) |
| ***F25B 25/00*** | (2006.01) |

(Continued)

(52) U.S. Cl.

CPC ..... *F25B 29/003* (2013.01); *F24F 1/32* (2013.01); *F24F 3/065* (2013.01); *F25B 25/005* (2013.01); *F25B 45/00* (2013.01); *F25B 13/00* (2013.01); *F25B 2313/023* (2013.01); *F25B 2313/0272* (2013.01); *F25B 2313/02732* (2013.01); *F25B 2313/02741* (2013.01); *F25B 2700/2104* (2013.01)

(58) Field of Classification Search

CPC ..... F25B 43/04; F25B 43/043; F24F 3/065
See application file for complete search history.

(56) References Cited

U.S. PATENT DOCUMENTS 2,321,964 A * 6/1943 Zieber ..... F25B 43/043 62/195
2,667,238 A * 1/1954 Bennett ..... G01L 3/20 188/264 D
2,906,106 A * 9/1959 Haas ..... B21B 35/143 464/156

(Continued)

FOREIGN PATENT DOCUMENTS

CN 101029786 A 9/2007
JP 05-280818 A 10/1993

(Continued)

OTHER PUBLICATIONS

Office Action dated May 6, 2015 issued in corresponding CN patent application No. 201180066883.0 (and English translation).

(Continued)

*Primary Examiner* — Ljiljana Ciric
*Assistant Examiner* — Alexis Cox
(74) *Attorney, Agent, or Firm* — Posz Law Group, PLC

(57) ABSTRACT

An air-conditioning apparatus including: a refrigerant circuit having a compressor, a refrigerant flow switching valve, a heat exchanger related to the heat transfer medium, an expansion valve, a heat source-side heat exchanger which is connected by a refrigerant pipe to form a refrigeration cycle, a heat transfer medium circuit having the heat exchanger related to the heat transfer medium, a pump, a plurality of use-side heat exchangers which are connected by a heat transfer medium pipe, and an opening and closing valve provided to the heat transfer medium supply pipe.

12 Claims, 8 Drawing Sheets

(51) Int. Cl.
*F25B 45/00* (2006.01)
*F25B 13/00* (2006.01)

(56) References Cited

U.S. PATENT DOCUMENTS 3,131,546 A * 5/1964 Osborne ..... F25B 43/046 62/195
5,078,756 A * 1/1992 Major ..... F25B 45/00 62/195
5,099,653 A * 3/1992 Major ..... F25B 45/00 62/149
5,243,831 A * 9/1993 Major ..... F25B 45/00 62/292
5,282,369 A * 2/1994 Ohuchi ..... F24F 3/06 165/219
6,405,551 B1 * 6/2002 Kuwabara ..... F24D 17/02 62/238.6
2004/0170950 A1 * 9/2004 Prien ..... A01N 1/0247 435/1.2
2006/0152072 A1 7/2006 Baechle et al.
2006/0192426 A1 8/2006 Baechle et al.
2007/0199337 A1 * 8/2007 Otake ..... F24D 17/02 62/183
2011/0192184 A1 * 8/2011 Yamashita ..... F24F 1/02 62/196.1
2012/0036876 A1 * 2/2012 Honda ..... F24D 11/0214 62/132

FOREIGN PATENT DOCUMENTS

JP 2001-289465 A 10/2001
JP 2002-147775 A 5/2002
JP 2003-343936 A 12/2003
JP 2005-140444 A 6/2005
JP 2005-535518 A 11/2005
JP 2009-097824 A 5/2009
WO 2010/049998 A1 5/2010
WO 2010/050006 A1 5/2010

OTHER PUBLICATIONS

Office Action mailed Feb. 18, 2014 issued in corresponding JP patent application No. 2012-556647 (and English translation).
International Search Report of the International Searching Authority mailed Apr. 12, 2011 for the corresponding international application No. PCT/JP2011/000654 (with English translation).
Office Action dated Jan. 14, 2016 issued in corresponding CN patent application No. 201180066883.0 (and English translation).
Office Action dated Jul. 20, 2016 issued in corresponding CN patent application No. 201180066883.0 (and English translation).

* cited by examiner (a)

(b)

○ · · · AIR BUBBLE ⇨ · · · FLOW OF WATER

AIR-CONDITIONING APPARATUS

CROSS REFERENCE TO RELATED APPLICATIONS

This application is a U.S. national stage application of PCT/JP2011/000654 filed on Feb. 7, 2011, the disclosure of which is incorporated herein by reference.

TECHNICAL FIELD

The present invention relates to an air-conditioning apparatus applied to a multi-air-conditioner for a building or the like, for example.

BACKGROUND

In some air-conditioning apparatuses, like a multi-air-conditioner for a building, a heat source unit (outdoor unit) is placed outside a structure, and an indoor unit is placed in the indoors of the structure. Refrigerant that circulates through a refrigerant circuit of such air-conditioning apparatuses rejects heat to (removes heat from) air supplied to a heat exchanger of the indoor unit to thereby heat or cool the air. Then, the heated or cooled air is sent to an air-conditioned space to perform heating or cooling. As refrigerants used in such air-conditioning apparatuses, for example, hydrofluorocarbon (HFC)-based refrigerants are frequently used. Air-conditioning apparatuses using natural refrigerants such as carbon dioxide ($CO_2$) have been also proposed.

An air-conditioning apparatus with a different configuration represented by a chiller system has been also proposed (for example, Patent Literature 1). In the technique described in Patent Literature 1, cooling energy or heating energy is generated in a heat source unit placed outdoors, a heat medium such as water or antifreeze liquid is heated or cooled by a heat exchanger placed inside an outdoor unit, and this is conveyed to an indoor unit such as a fan coil unit or a panel heater placed in an air-conditioned area to thereby execute cooling or heating.

There has been also proposed an air-conditioning apparatus in which a water pipe through which heated water flows, and a water pipe through which cooled water flows are individually connected between a heat source unit and an indoor unit (see, for example, Patent Literature 2). The technique described in Patent Literature 2 switches connections so that in a heating operation the water pipe through which heated water flows and the indoor unit are connected, and in a cooling operation the water pipe through which cooled water flows and the indoor unit are connected, thereby allowing cooling or heating to be freely selected.

There has been also proposed an air-conditioning apparatus configured so that a heat exchange unit provided with a heat exchanger for exchanging heat between a primary refrigerant and a secondary refrigerant is placed near an indoor unit, and the secondary refrigerant is conveyed to the indoor unit from the heat exchange unit (see, for example, Patent Literature 3).

There is also an air-conditioning apparatus configured so that an outdoor unit and a branch unit having a heat exchanger are connected by two pipes, and a secondary refrigerant is conveyed to an indoor unit (see, for example, Patent Literature 4).

PATENT LITERATURE

Patent Literature 1: Japanese Unexamined Patent Application Publication No. 2005-140444 (see, for example, FIG. 1)

Patent Literature 2: Japanese Unexamined Patent Application Publication No. 05-280818 (see, for example, paragraphs [0024] to [0026] of the specification, and FIG. 1)

Patent Literature 3: Japanese Unexamined Patent Application Publication No. 2001-289465 (see, for example, paragraph [0048] of the specification, and FIG. 1)

Patent Literature 4: Japanese Unexamined Patent Application Publication No. 2003-343936 (see, for example, FIG. 1)

In conventional air-conditioning apparatuses such as a multi-air-conditioner for a building, when the air-conditioning apparatus is filled with refrigerant, a vacuum is pulled by using a vacuum pump or the like to thereby release air to the outside of a refrigerant circuit. In this regard, in the air-conditioning apparatuses described in Patent Literatures 1 to 4, air is sometimes mixed into not only a refrigerant circuit through which a primary-side refrigerant circulates but also a circuit (secondary-side circuit) through which a heat medium such as water or antifreeze liquid circulates. Upon performing a heating operation or a cooling operation, if air is mixed in the secondary-side circuit, there is a possibility that the capability of a pump to convey the heat medium or the efficiency of heat exchange between the primary-side refrigerant and the secondary side refrigerant may decrease.

Accordingly, in a case where air is mixed into the circuit of a heat medium such as water or antifreeze liquid, usually, air is exhausted from an air purge valve by operating the pump while sending air into the circuit. However, in this method, air is simply circulated together with the heat medium and sent to the air purge valve by the pump, and thus it is not possible to exhaust air to the outside of the circuit with high efficiency (in a short time).

SUMMARY

The air-conditioning apparatus according to the present invention has been made in view of the above-mentioned problem, and accordingly its object is to release air in a heat medium circuit (secondary-side circuit) through which a heat medium circuits, to the outside of the heat medium circuit with high efficiency.

An air-conditioning apparatus according to the present invention has a refrigerant circuit having a compressor, a refrigerant flow switching device, a plurality of heat exchangers related to heat medium, an expansion device, and a heat source-side heat exchanger, which are connected by a refrigerant pipe to form a refrigeration cycle, and a heat medium circuit having the plurality of heat exchangers related to heat medium, a pump, and a plurality of use-side heat exchangers, which are connected by a heat medium pipe, the air-conditioning apparatus being capable of a cooling operation and a heating operation. The air-conditioning apparatus includes an opening and closing device that is provided in a heat medium supply pipe connected to the heat medium circuit so as to supply a heat medium, and that passes or cuts off the heat medium flowing from the heat medium supply pipe to the heat medium circuit, and an air release device that is provided in the heat medium circuit, and releases air remaining within the heat medium circuit and performs the heating operation while opening the opening and closing device and the air release device.

In the air-conditioning apparatus according to the present invention, a heating operation is performed while the opening and closing device and the air release device are opened, thereby releasing air from the heat medium circuit with high efficiency.

DESCRIPTION OF EMBODIMENTS

Hereinafter, Embodiment of the present invention will be described with reference to the drawings.

Figure 1:
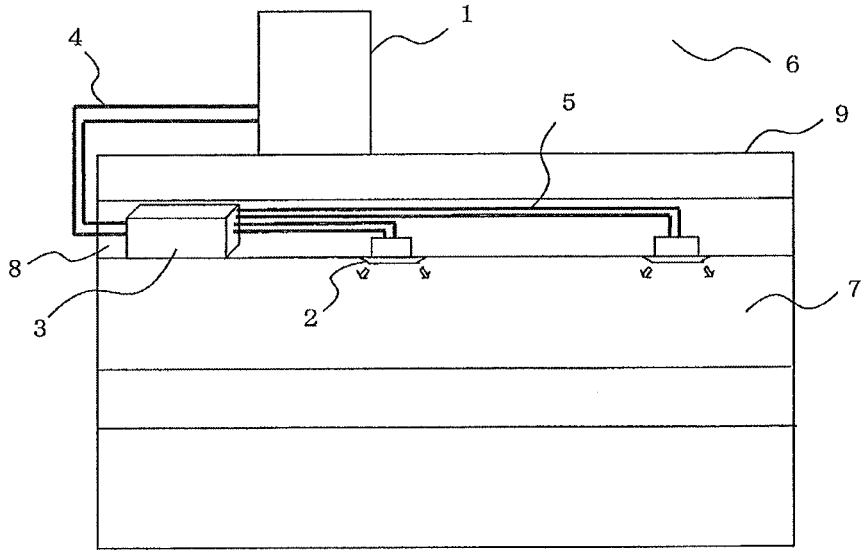
FIG. 1 is a schematic diagram illustrating an installation example of an air-conditioning apparatus according to Embodiment of the present invention.

FIG. 1 is a schematic diagram illustrating an installation example of an air-conditioning apparatus 100 according to Embodiment of the present invention. The installation example of the air-conditioning apparatus 100 will be described with reference to FIG. 1. In the drawings below including FIG. 1, the relative sizes of individual components may sometimes differ from the actuality.

The air-conditioning apparatus 100 according to Embodiment has a refrigerant circuit A (see FIG. 2) that is a refrigeration cycle through which a heat source-side refrigerant is circulated, and a heat medium circuit B (see FIG. 2) through which a heat medium is circulated. Further, as will be described later, the air-conditioning apparatus 100 has the function of releasing residual air (air bubbles) contained in the heat medium (for example, water, antifreeze liquid, or the like) flowing through the heat medium circuit B, to the outside of the heat medium circuit B with high efficiency (in a short time).

The air-conditioning apparatus 100 has the refrigerant circuit A (see FIG. 2) that is a refrigeration cycle through which the heat source-side refrigerant is circulated, and the heat medium circuit B (see FIG. 2) through which the heat medium is circulated, allowing individual indoor units to select a cooling operation or a heating operation.

The air-conditioning apparatus 100 has a cooling only operation mode as a mode in which the indoor units execute only a cooling operation, a heating only operation mode as a mode in which the indoor units execute only a heating operation, and a cooling and heating mixed operation mode in which indoor units that execute a cooling operation and a heating operation are mixed simultaneously. The cooling and heating mixed operation mode includes a cooling main operation mode in which the cooling load is greater, and a heating main operation mode in which the heating load is greater.

The air-conditioning apparatus 100 adopts a system that indirectly uses refrigerant (heat source-side refrigerant) (indirect system). That is, the air-conditioning apparatus 100 according to Embodiment transfers cooling energy or heating energy stored in the heat source-side refrigerant to a heat medium different from the heat source-side refrigerant, and cools or heats an air-conditioned space by the cooling energy or heating energy stored in the heat medium.

In FIG. 1, the air-conditioning apparatus 100 has a single outdoor unit 1 that is a heat source unit, a plurality of indoor units 2, and a heat medium relay unit 3 for transferring the cooling energy or heating energy of the heat source-side refrigerant flowing through the outdoor unit 1 to the heat medium flowing through the indoor unit 2. The heat medium relay unit 3 causes heat to be exchanged between the heat source-side refrigerant and the heat medium. The outdoor unit 1 and the heat medium relay unit 3 are connected by a refrigerant pipe 4 that flows the heat source-side refrigerant. The heat medium relay unit 3 and the indoor unit 2 are connected by a heat medium pipe 5 that flows the heat medium. Cooling energy or heating energy generated in the outdoor unit 1 is transferred to the heat medium in the heat medium relay unit 3, and delivered to the indoor unit 2.

The outdoor unit 1 is usually placed in an outdoor space 6, which is a space outside a structure 9 such as a building (for example, a rooftop or the like). The outdoor unit 1 supplies cooling energy or heating energy to the indoor unit 2 via the heat medium relay unit 3. The indoor unit 2 is placed at a position that allows cooling air or heating air to be supplied to an indoor space 7, which is a space inside the structure 9 (for example, a living room or the like). The indoor unit 2 supplies cooling air or heating air to the indoor space 7 that is the air-conditioned space. The heat medium relay unit 3 is configured to be installed at a position different from the outdoor space 6 and the indoor space 7, as a separate casing from the outdoor unit 1 and the indoor unit 2. The heat medium relay unit 3 is connected to the outdoor unit 1 and the indoor unit 2 by the refrigerant pipe 4 and the heat medium pipe 5, respectively, and transfers cooling energy or heating energy supplied from the outdoor unit 1 to the indoor unit 2.

As illustrated in FIG. 1, in the air-conditioning apparatus 100 according to Embodiment, the outdoor unit 1 and the heat medium relay unit 3 are connected via the refrigerant pipe 4, and the heat medium relay unit 3 and each indoor unit 2 are connected via the heat medium pipe 5. In this way, in the air-conditioning apparatus 100, individual units (the outdoor unit 1, the indoor unit 2, and the heat medium relay unit 3) are connected by using the refrigerant pipe 4 and the heat medium pipe 5, thereby allowing easy construction.

FIG. 1 illustrates, by way of example, a state in which the heat medium relay unit 3 is installed in a space that is located inside the structure 9 but is a separate space from the indoor space 7, such as a space above a ceiling (for example, a space such as above a ceiling in the structure 9; hereinafter, simply referred to as space 8). Alternatively, the heat medium relay unit 3 can be also installed in a common use space or the like where an elevator or the like is located. While FIG. 1 illustrates a case where the indoor unit 2 is of a ceiling cassette type by way of example, this is not intended to be limitative. The indoor unit 2 is not particularly limited as long as heating air or cooling air can be supplied to the indoor space 7 directly or through a duct or the like, such as a ceiling concealed type or ceiling suspended type.

While FIG. 1 illustrates a case where the outdoor unit 1 is installed in the outdoor space 6 by way of example, this is not intended to be limitative. For example, the outdoor unit 1 may be installed in an enclosed space such as a machine room with ventilation openings. The outdoor unit 1 may be installed inside the structure 9 as long as waste heat can be exhausted to the outside of the structure 9 by an exhaust duct. Alternatively, the outdoor unit 1 may be installed inside the structure 9 also in a case where a water-cooled outdoor unit 1 is used.

The heat medium relay unit 3 may be installed at a position near the outdoor unit 1 and far from the indoor unit 2. However, the heat medium relay unit 3 is preferably installed while keeping in mind the fact that if the distance from the heat medium relay unit 3 to the indoor unit 2 becomes too long, the power (energy) necessary for conveying the heat medium becomes very large, with the result that the energy saving effect diminishes. Further, the numbers of the outdoor units 1, indoor units 2, and heat medium relay units 3 to be connected is not particularly limited but may be determined in accordance with the structure 9.

Figure 2:
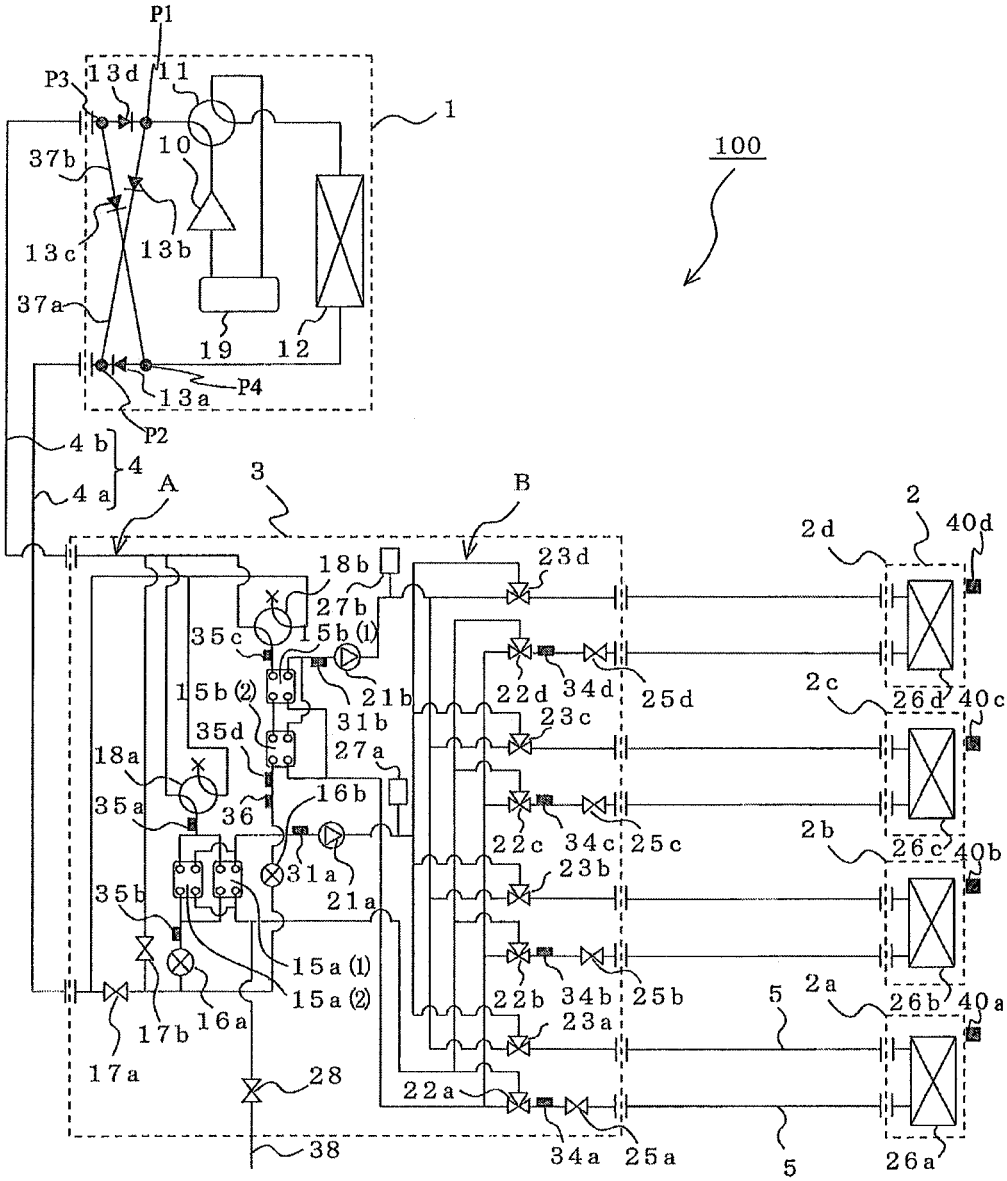
FIG. 2 is a refrigerant circuit configuration example of the air-conditioning apparatus according to Embodiment of the present invention.

FIG. 2 is a refrigerant circuit configuration example of the air-conditioning apparatus 100 according to Embodiment of the present invention. The refrigerant circuit configuration of the air-conditioning apparatus 100 will be described with reference to FIG. 2. As illustrated in FIG. 2, the outdoor unit 1, and heat exchangers related to heat medium 15*a*(1), 15*a*(2), 15*b*(1), and 15*b*(2) provided in the heat medium relay unit 3 are connected via the refrigerant pipe 4. In the following description, the heat exchangers related to heat medium 15*a*(1) and 15*a*(2) will sometimes be also simply referred to as heat exchanger related to heat medium 15*a*, and the heat exchangers related to heat medium 15*b*(1) and 15*b*(2) will sometimes be also simply referred to as heat exchanger related to heat medium 15*b*. Further, the heat exchangers related to heat medium 15*a* and 15*b* will sometimes be also simply referred to as heat exchanger related to heat medium 15. The heat exchanger related to heat medium 15, and indoor units 2*a* to 2*d* (sometimes also simply referred to as indoor units 2) are connected via the heat medium pipe 5.

[Outdoor Unit 1]

The outdoor unit 1 is provided with a compressor 10, a first refrigerant flow switching device 11, a heat source-side heat exchanger 12, and an accumulator 19 that are connected by the refrigerant pipe.

The compressor 10 sucks refrigerant, compresses the refrigerant into a high-temperature/high-pressure state, and conveys the resulting refrigerant to the refrigerant circuit A. The discharge side of the compressor 10 is connected to the first refrigerant flow switching device 11, and the suction side thereof is connected to the accumulator 19. The compressor 10 may be configured by, for example, an inverter compressor or the like whose capacity can be controlled.

The first refrigerant flow switching device 11 connects the discharge side of the compressor 10 and a check valve 13*b*, and the heat source-side heat exchanger 12 and the suction side of the accumulator 19 in heating only operation mode and in heating main operation mode of the cooling and heating mixed operation mode. The first refrigerant flow switching device 11 connects the discharge side of the compressor 10 and the heat source-side heat exchanger 12, and a check valve 13*d* and the suction side of the accumulator 19 in cooling only operation mode and in cooling main operation mode of the cooling and heating mixed operation mode. The first refrigerant flow switching device 11 may be configured by, for example, a four-way valve or the like.

The heat source-side heat exchanger 12 functions as an evaporator in heating operation, and functions as a condenser (radiator) in cooling operation. The heat source-side heat exchanger 12 can cause the heat source-side refrigerant to evaporate and gasify or condense and liquefy by exchanging heat between air supplied from an unillustrated air-sending device such as a fan, and the refrigerant.

In heating operation mode, one side of the heat source-side heat exchanger 12 is connected to a check valve 13*c*, and the other side thereof is connected to the suction side of the accumulator 19. In cooling operation mode, one side of the heat source-side heat exchanger 12 is connected to the discharge side of the compressor 10, and the other side thereof is connected to a check valve 13*a*. The heat source-side heat exchanger 12 may be configured by, for example, a plate fin and tube heat exchanger that is capable of exchanging heat between the refrigerant flowing through the refrigerant pipe and the air passing through fins.

The accumulator 19 accumulates excess refrigerant resulting from the difference between the heating operation mode and the cooling operation mode, or excess refrigerant for transient changes in operation (for example, changes in the number of indoor units 2 to be operated). In heating operation mode, the suction side of the accumulator 19 is connected to the heat source-side heat exchanger 12, and the discharge side thereof is connected to the suction side of the compressor 10. In cooling operation mode, the suction side of the accumulator 19 is connected to the check valve 13*d*, and the discharge side thereof is connected to the suction side of the compressor 10.

The outdoor unit 1 is provided with a connection pipe 37*a*, a connection pipe 37*b*, the check valve 13*a*, the check valve 13*b*, the check valve 13*c*, and the check valve 13*d*. The provision of these components allows the heat source-side refrigerant, which is caused to enter the heat medium relay unit 3 from the outdoor unit 1, to flow in a constant direction irrespective of the operation mode of the air-conditioning apparatus 100.

For the air-conditioning apparatus 100 according to Embodiment, the refrigerant circuit A provided with the connection pipe 37*a*, the connection pipe 37*b*, the check valve 13*a*, the check valve 13*b*, the check valve 13*c*, and the check valve 13*d* is illustrated by way of example. However, the refrigerant circuit A is not particularly limited, and may not be provided with the connection pipe 37*a*, the connection pipe 37*b*, the check valve 13*a*, the check valve 13*b*, the check valve 13*c*, or the check valve 13*d*.

The connection pipe 37*a* is a refrigerant pipe that connects from Point P1 to Point P2 illustrated in FIG. 2. The connection pipe 37*b* is a refrigerant pipe that connects from Point P3 to Point P2.

The check valve 13*a* is provided in a portion of the refrigerant pipe constituting the refrigerant circuit A which connects from Point P3 to Point P4. Owing to the check valve 13*a*, in the refrigerant pipe that connects from Point P3 to Point P4, the heat source-side refrigerant only flows in the direction from Point P3 toward Point P4. The check valve 13*b* is provided in the connection pipe 37*a*. Owing to the check valve 13*b*, in the connection pipe 37*a*, the heat source-side refrigerant only flows in the direction from Point 1 toward Point P2. The check valve 13*c* is provided in the connection pipe 37*b*. Owing to the check valve 13*c*, in the refrigerant pipe that connects from Point P3 to Point P4, the heat source-side refrigerant only flows in the direction from Point P3 toward Point P4. The check valve 13*d* is provided in a portion of the refrigerant pipe constituting the refrigerant circuit A which connects from Point P3 to Point P1.

Owing to the check valve 13*d*, in the refrigerant pipe that connects from Point P3 to Point P1, the heat source-side refrigerant only flows in the direction from Point P3 toward Point P1.

[Indoor Unit 2]

The indoor units 2 are provided with respective use-side heat exchangers 26*a* to 26*d* (sometimes also simply referred to as use-side heat exchangers 26). The use-side heat exchangers 26 are connected to respective heat medium flow control devices 25*a* to 25*d* (sometimes also simply referred to as heat medium flow control devices 25) via the heat medium pipe 5, and second heat medium flow switching devices 23*a* to 23*d* (sometimes also simply referred to as second heat medium flow switching devices 23) via the heat medium pipe 5. Each of the use-side heat exchangers 26 exchanges heat between air supplied from an unillustrated air-sending device such as a fan, and the heat medium, and generates the heating air or cooling air that is to be supplied to the indoor space 7.

FIG. 2 illustrates a case where four indoor units 2*a* to 2*d* are connected to the heat medium relay unit 3 via the heat medium pipe 5 by way of example. In association with the indoor units 2*a* to 2*d*, the use-side heat exchangers 26 are also illustrated as the use-side heat exchanger 26*a*, the use-side heat exchanger 26*b*, the use-side heat exchanger 26*c*, and the use-side heat exchanger 26*d* from the lower side in the plane of the drawing. The number of indoor units 2 to be connected is not limited to four.

[Heat Medium Relay Unit 3]

The heat medium relay unit 3 is equipped with four heat exchangers related to heat medium 15*a* to 15*d*, two expansion devices 16*a* and 16*b* (sometimes also simply referred to as expansion devices 16), two opening and closing devices 17*a* and 17*b* (sometimes also simply referred to as opening and closing devices 17), two second refrigerant flow switching devices 18*a* and 18*b* (sometimes also simply referred to as second refrigerant flow switching devices 18), two pumps 21*a* and 21*b* (sometimes also simply referred to as pumps 21), four first heat medium flow switching devices 22*a* to 22*d* (sometimes also simply referred to as first heat medium flow switching devices 22), four second heat medium flow switching devices 23*a* to 23*d* (sometimes also simply referred to as second heat medium flow switching devices 23), and four heat medium flow control devices 25*a* to 25*d* (sometimes also simply referred to as heat medium flow control devices 25).

Each of the heat exchangers related to heat medium 15 (load-side heat exchanger) functions as a condenser (radiator) or an evaporator, exchanges heat between the heat source-side refrigerant and the heat medium, and transfers the cooling energy or heating energy generated in the outdoor unit 1 and stored in the heat source-side refrigerant to the heat medium.

The two heat exchangers related to heat medium 15*a* are connected to a position in the pipe that connects the expansion device 16*a* and the second refrigerant flow switching device 18*a* in the refrigerant circuit A illustrated in FIG. 2, and cool the heat medium in cooling and heating mixed operation mode.

The two heat exchangers related to heat medium 15*b* are connected to a position in the pipe that connects the expansion device 16*b* and the second refrigerant flow switching device 18*b* in the refrigerant circuit A illustrated in FIG. 2, and heat the heat medium in cooling and heating mixed operation mode.

In the refrigerant circuit A, the two heat exchangers related to heat medium 15*a* are connected in parallel to a position in the refrigerant pipe that connects from the expansion device 16*a* to the second refrigerant flow switching device 18*a*.

In this regard, generally, a refrigerant at low temperature and low pressure has a low density. Accordingly, both of the heat exchangers related to heat medium 15*a* through which a refrigerant at low temperature and low pressure flows in cooling and heating mixed operation mode are connected in parallel, and the flow velocity of the refrigerant is lowered to reduce pressure loss, thereby improving the efficiency of the refrigeration cycle in cooling and heating mixed operation mode.

In the refrigerant circuit A, the two heat exchangers related to heat medium 15*b* are connected in parallel to a position in the refrigerant pipe that connects from the expansion device 16*b* to the second refrigerant flow switching device 18*b*.

In this regard, a refrigerant at high temperature and high pressure has a high density. Accordingly, both of the heat exchangers related to heat medium 15*b* through which a refrigerant at high temperature and high pressure flows in cooling and heating mixed operation mode are connected in series, and the flow velocity of the refrigerant is increased to thereby improve the efficiency of heat exchange between the heat source-side refrigerant and the heat medium in cooling and heating mixed operation mode. In cooling and heating mixed operation mode, a high-pressure refrigerant flows to the heat exchanger related to heat medium 15*b*, and thus pressure loss is reduced.

In the heat medium circuit B, both of the heat exchangers related to heat medium 15*a* are connected in parallel to a position in the pipe that connects from the first heat medium flow switching device 22 to the pump 21*a*.

Likewise, in the heat medium circuit B, both of the heat exchangers related to heat medium 15*b* are also connected in parallel to a position in the pipe that connects from the first heat medium flow switching device 22 to the pump 21*b*.

The expansion device 16 has a function as a pressure reducing valve or an expansion valve, and causes the heat source-side refrigerant to be decompressed and expand. The expansion device 16*a* is provided downstream of the heat exchangers related to heat medium 15*a* in the flow of the heat source-side refrigerant in heating only operation mode (see FIG. 3). The expansion device 16*b* is provided downstream of the heat exchanger related to heat medium 15*b*(2) in the flow of the heat source-side refrigerant in heating only operation mode (see FIG. 3). Each of the expansion devices 16 may be configured by a device whose opening degree can be variably controlled, for example, an electronic expansion valve or the like.

The opening and closing devices 17 open and close respective flow path in which the opening and closing devices 17 are provided. The opening and closing device 17*a* is provided in a refrigerant pipe 4*a* that is on the inlet side of the heat medium relay unit 3, with respect to the refrigerant entering from the outdoor unit 1. The opening and closing device 17*b* is provided in a pipe that connects the refrigerant pipe 4*a* that is on the inlet side of the heat medium relay unit 3, and a refrigerant pipe 4*b* that is on the outlet side thereof, with respect to the refrigerant entering from the outdoor unit 1. The opening and closing devices 17 may each be configured by, for example, a two-way valve or the like.

The second refrigerant flow switching device 18 switches among the flow of refrigerant in heating only operation mode, the flow of refrigerant in cooling only operation mode, and the flow of refrigerant in cooling and heating mixed operation mode. The second refrigerant flow switching device 18*b* connects the refrigerant pipe 4*a* and the heat exchanger related to heat medium 15*b*(1) in heating only operation mode. The second refrigerant flow switching device 18*a* connects the refrigerant pipe 4*b*, and the heat exchanger related to heat medium 15*a*(1) and the heat exchanger related to heat medium 15*a*(2) in cooling only operation mode and in cooling and heating mixed operation mode. The second refrigerant flow switching device 18 may be configured by, for example, a four-way valve or the like.

The pumps 21 cause the heat medium flowing to the heat medium pipe 5 to circulate. The pump 21*a* is connected to a position in the portion of the heat medium pipe 5 which connects the heat exchangers related to heat medium 15*a* and the second heat medium flow switching devices 23. The pump 21*b* is connected to a position in the portion of the heat medium pipe 5 which connects the heat exchangers related to heat medium 15*b* and the second heat medium flow switching devices 23. The two pumps 21 may each be configured by, for example, a pump or the like whose capacity can be controlled.

The pump 21*a* may be connected to a position in the portion of the heat medium pipe 5 which connects the heat exchangers related to heat medium 15*a* and the first heat medium flow switching device 22. The pump 21*b* may be connected to a position in the portion of the heat medium pipe 5 which connects the heat exchangers related to heat medium 15*b* and the first heat medium flow switching device 22.

The first heat medium flow switching device 22 switches the flow path of the heat medium. The number of first heat medium flow switching devices 22 to be provided (four in this case) correspond to the number of indoor units 2 to be installed. In the first heat medium flow switching device 22, one of the three sides is connected to the heat exchangers related to heat medium 15*a*, one of the three sides is connected to the heat exchangers related to heat medium 15*b*, and one of the three sides is connected to the heat medium flow control device 25. The first heat medium flow switching device 22 is provided on the outlet side of the heat medium flow path of the use-side heat exchangers 26. In association with the indoor units 2, the first heat medium flow switching devices 22 are illustrated as the first heat medium flow switching device 22*a*, the first heat medium flow switching device 22*b*, the first heat medium flow switching device 22*c*, and the first heat medium flow switching device 22*d* from the lower side in the plane of the drawing. The first heat medium flow switching devices 22 may each be configured by, for example, a three-way valve or the like.

The second heat medium flow switching devices 23 switch the flow path of the heat medium. The number of second heat medium flow switching devices 23 to be provided (four in this case) correspond to the number of indoor units 2 to be installed. In the second heat medium flow switching devices 23, one of the three sides is connected to the heat exchangers related to heat medium 15*a*, one of the three sides is connected to the heat exchangers related to heat medium 15*b*, and one of the three sides is connected to the use-side heat exchangers 26. The second heat medium flow switching devices 23 are provided on the inlet side of the heat medium flow paths of the use-side heat exchangers 26. In association with the indoor units 2, the second heat medium flow switching devices 23 are illustrated as the second heat medium flow switching device 23*a*, the second heat medium flow switching device 23*b*, the second heat medium flow switching device 23*c*, and the second heat medium flow switching device 23*d* from the lower side in the plane of the drawing. The second heat medium flow switching devices 23 may each be configured by, for example, a three-way valve or the like.

The heat medium flow control device 25 controls the flow rate of the heat medium flowing in the heat medium pipe 5. The number of heat medium flow control devices 25 to be provided (four in this case) correspond to the number of indoor units 2 to be installed. One side and the other side of each heat medium flow control device 25 are connected to the corresponding use-side heat exchanger 26 and the corresponding first heat medium flow switching device 22, respectively. The heat medium flow control device 25 is provided on the outlet side of the heat medium flow path of the corresponding use-side heat exchanger 26. In association with the indoor units 2, the second heat medium flow control devices 25 are illustrated as the second heat medium flow control device 25*a*, the second heat medium flow control device 25*b*, the second heat medium flow control device 25*c*, and the second heat medium flow control device 25*d* from the lower side in the plane of the drawing. The heat medium flow control devices 25 may each be provided on the inlet side of the heat medium flow path of the corresponding use-side heat exchanger 26. The heat medium flow control devices 25 may each be configured by, for example, a two-way valve or the like whose opening area can be controlled.

The heat medium relay unit 3 is provided with various detecting means (two first temperature sensors 31*a* and 31*b*, four second temperature sensors 34*a* to 34*d*, four third temperature sensors 35*a* to 35*d*, a pressure sensor 36, and four indoor temperature sensors 40*a* to 40*d* in FIG. 2). Pieces of information detected by these detecting means (temperature information and pressure information) are sent to a controller that controls the operation of the air-conditioning apparatus 100 in a centralized manner, and are used to control the air-conditioning apparatus 100.

The two first temperature sensors 31*a* and 31*b* (sometimes also simply referred to as first temperature sensors 31) detect the temperature of the heat medium that has exited the heat exchanger related to heat medium 15, that is, the temperature of the heat medium at the outlet of the heat exchangers related to heat medium 15. The first temperature sensor 31*a* is provided in the heat medium pipe 5 on the inlet side of the pump 21*a*. The first temperature sensor 31*b* is provided in the heat medium pipe 5 on the inlet side of the pump 21*b*. The first temperature sensors 31 may each be configured by, for example, a thermistor or the like.

The four second temperature sensors 34*a* to 34*d* (sometimes also simply referred to as second temperature sensors 34) are provided between the first heat medium flow switching devices 22 and the heat medium flow control devices 25, and detect the temperature of the heat medium that has exited the use-side heat exchangers 26. The number of second temperature sensors 34 to be provided (four in this case) corresponds to the number of indoor units 2 to be installed. In association with the indoor units 2, the second temperature sensors 34 are illustrated as the second temperature sensor 34*a*, the second temperature sensor 34*b*, the second temperature sensor 34*c*, and the second temperature sensor 34*d* from the lower side in the plane of the drawing. The second temperature sensors 34 may each be configured by, for example, a thermistor or the like.

The four third temperature sensors 35*a* to 35*d* (sometimes also simply referred to as third temperature sensors 35) are provided on the inlet sides or outlet sides of the heat source-side refrigerant of the heat exchangers related to heat medium 15, and detect the temperatures of the heat source-side refrigerant entering the heat exchangers related to heat medium 15 or the temperatures of the heat source-side refrigerant exiting the heat exchangers related to heat medium 15. The third temperature sensor 35*a* is provided between the heat exchanger related to heat medium 15*a* and the second refrigerant flow switching device 18*a*. The third temperature sensor 35*b* is provided between the heat exchangers related to heat medium 15*a* and the expansion device 16*a*. The third temperature sensor 35*c* is provided between the heat exchangers related to heat medium 15*b* and the second refrigerant flow switching device 18*b*. The third temperature sensor 35*d* is provided between the heat exchangers related to heat medium 15*b* and the expansion device 16*b*. The third temperature sensors 35 may each be configured by, for example, a thermistor or the like.

Like the installation position of the third temperature sensor 35*d*, the pressure sensor 36 is provided between the heat exchangers related to heat medium 15*b* and the expansion device 16*b*. The pressure sensor 36 detects the pressure of the heat source-side refrigerant flowing between the heat exchangers related to heat medium 15*b* and the expansion device 16*b*.

The four indoor temperature sensors 40*a* to 40*d* (sometimes also simply referred to as indoor temperature sensors 40) detect the temperatures of air-conditioning spaces corresponding to the indoor units 2*a* to 2*d*, respectively. The locations where the four indoor temperature sensors 40 are provided are not particularly limited, however, the four indoor temperature sensors 40 had better be placed in respective locations where the indoor units 2*a* to 2*d* are installed, for example. The indoor temperature sensors 40 may each be configured by, for example, a thermistor or the like.

The controller (not illustrated) is configured by a microcomputer or the like. The controller executes various operation modes described later by controlling the driving frequency of the compressor 10, the rotation speed (including ON/OFF) of the air-sending device (not illustrated), switching of the first refrigerant flow switching device 11, driving of the pumps 21, the opening degree of the expansion device 16, opening and closing of the opening and closing devices 17, switching of the second refrigerant flow switching device 18, switching of the first heat medium flow switching devices 22, switching of the second heat medium flow switching devices 23, the opening degree of the heat medium flow control devices 25, an opening and closing device 28 (heat-medium-supply-path opening and closing device) described later, an air release device 27 described later, and the like, on the basis of information detected by various detecting means and instructions from a remote control. The controller may be provided in each unit, or may be provided in the outdoor unit 1 or the heat medium relay unit 3.

The heat medium pipe 5 through which the heat medium flows is configured by a pipe that is connected to the heat exchangers related to heat medium 15*a*, and a pipe that is connected to the heat exchangers related to heat medium 15*b*. The heat medium pipe 5 is branched off (branched off into four parts in this case) in accordance with the number of indoor units 2 connected to the heat medium relay unit 3. The heat medium pipe 5 is connected to the first heat medium flow switching devices 22 and the second heat medium flow switching devices 23. Whether to make the heat medium from the heat exchangers related to heat medium 15*a* enter the use-side heat exchangers 26 or make the heat medium from the heat exchangers related to heat medium 15*b* enter the use-side heat exchangers 26 is determined by controlling the first heat medium flow switching devices 22 and the second heat medium flow switching devices 23.

In the air-conditioning apparatus 100, the refrigerant circuit A is formed by connecting the compressor 10, the first refrigerant flow switching device 11, the heat source-side heat exchanger 12, the opening and closing devices 17, the expansion devices 16, the heat source-side refrigerant flow paths of the heat exchangers related to heat medium 15, the second refrigerant flow switching device 18, and the accumulator 19 by the refrigerant pipe 4. The heat medium circuit B is formed by connecting the heat medium flow paths of the heat exchangers related to heat medium 15, the pumps 21, the first heat medium flow switching devices 22, the heat medium flow control devices 25, the use-side heat exchangers 26, and the second heat medium flow switching devices 23 by the heat medium pipe 5. That is, a plurality of use-side heat exchangers 26 are connected in parallel to each of the heat exchangers related to heat medium 15, so that the heat medium circuit B is made up of a plurality of lines.

Therefore, in the air-conditioning apparatus 100, the outdoor unit 1 and the heat medium relay unit 3 are connected via the heat exchangers related to heat medium 15*a* and the heat exchangers related to heat medium 15*b* that are provided in the heat medium relay unit 3, and the heat medium relay unit 3 and the indoor unit 2 are connected via the heat exchangers related to heat medium 15*a* and the heat exchangers related to heat medium 15*b*. That is, in the air-conditioning apparatus 100, the heat source-side refrigerant that circulates through the refrigerant circuit A, and the heat medium that circulates through the heat medium circuit B exchange heat in the heat exchangers related to heat medium 15*a* and the heat exchangers related to heat medium 15*b*.

[Air Release Mechanism]

A heat medium supply pipe 38 is a pipe for refilling the heat medium circuit B with the heat medium. One side of the heat medium supply pipe 38 is connected to a pipe that connects the heat exchangers related to heat medium 15*a* and the first heat medium flow switching device 22. The other side of the heat medium supply pipe 38 is connected to a heat medium source that can supply the heat medium (a water pipe or the like in a case where the heat medium is water).

The opening and closing device 28 (heat-medium-supply-path opening and closing device) is capable of opening and closing the flow path in which the opening and closing device 28 is provided, thereby switching between supply and cut-off of the heat medium to the heat medium circuit B. The opening and closing of the opening and closing device 28 are controlled by the controller. The opening and closing device 28 is provided in the heat medium supply pipe 38. The opening and closing device 28 may be configured by, for example, a two-way valve or the like.

Figure 3:
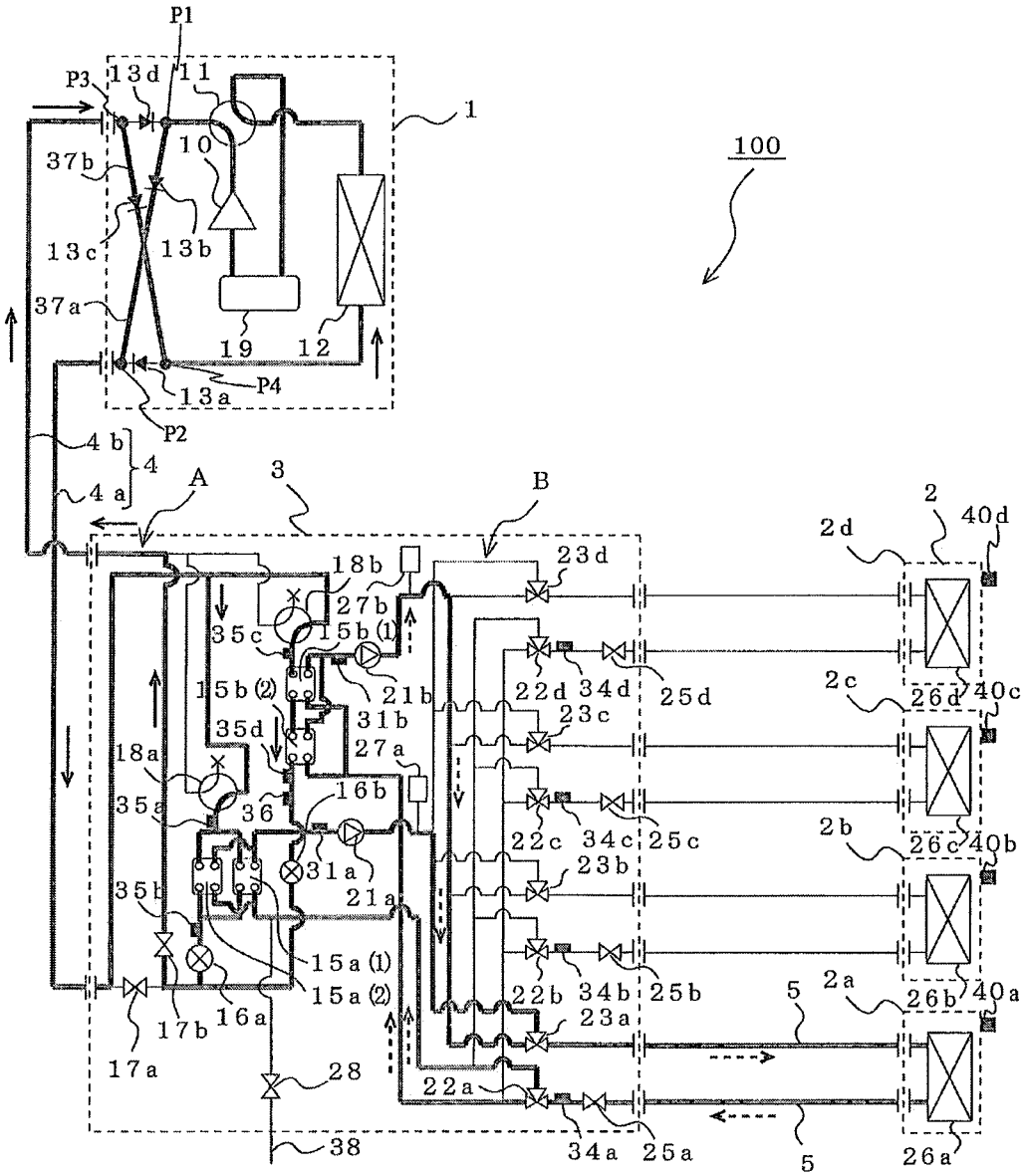
FIG. 3 is a refrigerant circuit diagram illustrating the flow of refrigerant in a heating-use air release operation of the air-conditioning apparatus illustrated in FIG. 2.

Two air release devices 27*a* and 27*b* (sometimes also simply referred to as air release devices 27) release air (residual air) contained in the heat medium circulating through the heat medium circuit B to the outside. The air release device 27*a* is provided in a pipe that connects the discharge side of the pump 21*a* and the second heat medium flow switching device 23. In heating-use air release operation mode described later, the position where the air release device 27*b* is installed is not particularly limited, and as illustrated in FIG. 3, for example, the air release device 27*b* may be provided in a pipe that connects the discharge side of the pump 21*b* and the second heat medium flow switching device 23. In heating-main-operation-use air release operation described later, the air release devices 27 are provided in pipes that connect from the first heat medium flow switching devices 22 to the heat exchangers related to heat medium 15 (see FIG. 4).

The air release devices 27 may each be configured by, for example, a manual air purge valve or the like. In a case where each of the air release devices 27 is a manual air purge valve, by opening the air release device 27 while opening the opening and closing device 28, air within the heat medium circuit B is released to the outside together with the heat medium. Then, an amount of heat medium corresponding to the amount of the released heat medium is supplied to the heat medium circuit B via the opening and closing device 28. It is needless to mention that the opening and closing of the air release devices 27 are controlled by the controller. In the following description, it is supposed that the air release devices 27 are controlled by the controller.

In the air-conditioning apparatus 100, on the basis of instruction from each indoor unit 2, a cooling operation or a heating operation is possible in the corresponding indoor unit 2. That is, the air-conditioning apparatus 100 allows all of the indoor units 2 to execute the same operation, and allows the individual indoor units 2 to execute different operations.

Operation modes executed by the air-conditioning apparatus 100 include a cooling only operation mode in which the driving indoor units 2 execute only a cooling operation, a heating only operation mode in which the driving indoor units 2 execute only a heating operation, a cooling main operation mode as a cooling and heating mixed operation mode in which the cooling load is greater, and a heating main operation mode as a cooling and heating mixed operation mode in which the heating load is greater.

The air-conditioning apparatus 100 makes the air release devices 27 and the opening and closing device 28 open while heating the heat medium to a predetermined temperature or more by executing the heating only operation mode or heating main operation mode, thereby allowing air contained in the heat medium to be released to the outside of the heat medium circuit B with high efficiency. Hereinafter, air release operations executed by the air-conditioning apparatus 100 will be described.

[Heating-Use Air Release Operation]

A heating-use air release operation mode starts when the user manually inputs. Alternatively, the heating-use air release operation mode may automatically start by opening the opening and closing device 28 and the air release devices 27 during heating operation.

Further, in heating-use air release operation mode, in a case where the temperature detected by the indoor temperature sensor 40 is less than a predetermined value, a heating only operation may be performed automatically for a predetermined time while the opening and closing device 28 and the air release devices 27 are opened. In this case, upon determining that the temperature detected by the indoor temperature sensor 40 is less than a predetermined value, the controller opens the opening and closing device 28 and the air release devices 27 and performs a heating only operation, and the operation is continued for a predetermined time while keeping the temperature of the heat medium much higher than a predetermined value.

The predetermined value related to the detected temperature mentioned above may be set to, for example, substantially 30 degrees C. The value of the predetermined time mentioned above is not particularly limited. Further, in a case where a heating load is generated only in the use-side heat exchanger 26*a*, for example, the temperature detected by the indoor temperature sensor 40*a* is adopted.

In this way, in heating-use air release operation mode, the heat medium is heated to lower the solubility of air in the heat medium, causing elution of air from the heat medium. Thus, air can be released from the air release devices 27 to the outside of the heat medium circuit B with high efficiency. The heating-use air release operation mode may be performed prior to air-conditioning operation, for example.

FIG. 3 is a refrigerant circuit diagram illustrating the flow of refrigerant in heating-use air release operation mode of the air-conditioning apparatus 100. In FIG. 3, the heating-use air release operation mode will be described with respect to a case where a heating load is generated only in the use-side heat exchanger 26*a* by way of example. In FIG. 3, pipes indicated by thick lines represent pipes through which the refrigerant (the heat source-side refrigerant and the heat medium) flows. In FIG. 3, the flow direction of the heat source-side refrigerant is indicated by solid arrows, and the flow direction of the heat medium is indicated by broken arrows.

In the case of the heating-use air release operation mode illustrated in FIG. 3, in the outdoor unit 1, the first refrigerant flow switching device 11 is switched so as to cause the heat source-side refrigerant discharged from the compressor 10 to enter the heat medium relay unit 3 without passing through the heat source-side heat exchanger 12. In the heat medium relay unit 3, the pump 21*a* and the pump 21*b* are driven, the heat medium flow control device 25*a* is opened, and the heat medium flow control devices 25*b* to 25*c* are fully closed, so that the heat medium circulates between each of the heat exchangers related to heat medium 15*a*(1) and 15*a*(2) and the heat exchangers related to heat medium 15*b*(1) and 15*b*(2), and the use-side heat exchanger 26*a*.

First, the flow of the heat source-side refrigerant in the refrigerant circuit A will be described.

A low-temperature/low-pressure refrigerant is compressed by the compressor 10, and discharged as a high-temperature/high-pressure gas refrigerant. The high-temperature/high-pressure gas refrigerant discharged from the compressor 10 exits the outdoor unit 1 via the first refrigerant flow switching device 11 and the connection pipe 37*a*. The high-temperature/high-pressure gas refrigerant that has exited the outdoor unit 1 enters the heat medium relay unit 3 via the refrigerant pipe 4*a*. The high-temperature/high-pressure gas refrigerant that has entered the heat medium relay unit 3 is branched off, and enters each of the second refrigerant flow switching device 18*a* and the second refrigerant flow switching device 18*b*. The refrigerant that has entered the second refrigerant flow switching device 18*a* is then branched off and enters each of the heat exchanger related to heat medium 15*a*(1) and the heat exchanger related to heat medium 15*a*(2). The refrigerant that has entered the second refrigerant flow switching device 18*b* enters the heat exchanger related to heat medium 15*b*(1), and then enters the heat exchanger related to heat medium 15*a*(2).

The high-temperature/high-pressure gas refrigerant that has entered the heat exchangers related to heat medium 15 condenses and liquefies while rejecting heat to the heat medium circulating through the heat medium circuit B, and turns into a high-pressure liquid refrigerant.

The liquid refrigerant that has exited the heat exchangers related to heat medium 15*a* is expanded in the expansion device 16*a*, and turns into a low-temperature/low-pressure two-phase refrigerant. The liquid refrigerant that has exited the heat exchangers related to heat medium 15*b* is expanded in the expansion device 16*b*, and turns into a low-temperature/low-pressure two-phase refrigerant. After these two-phase refrigerants merge, the resulting refrigerant exits the heat medium relay unit 3 via the opening and closing device 17*b*, and passes through the refrigerant pipe 4*b* and enters the outdoor unit 1 again. The refrigerant that has entered the outdoor unit 1 enters the heat source-side heat exchanger 12 that functions as an evaporator, via the connection pipe 37*b*.

Then, the refrigerant that has entered the heat source-side heat exchanger 12 removes heat from the outdoor air in the heat source-side heat exchanger 12, and turns into a low-temperature/low-pressure gas refrigerant. The low-temperature/low-pressure gas refrigerant that has exited the heat source-side heat exchanger 12 is sucked into the compressor 10 again via the first refrigerant flow switching device 11 and the accumulator 19.

At this time, the opening degree of the expansion device 16*a* is controlled so that the subcooling (degree of subcooling) obtained as the difference between a value obtained by converting the pressure detected by the pressure sensor 36 into saturation temperature, and the temperature detected by the third temperature sensor 35*b* becomes constant. Likewise, the opening degree of the expansion device 16*b* is controlled so that the subcooling obtained as the difference between a value obtained by converting the pressure detected by the pressure sensor 36 into saturation temperature, and the temperature detected by the third temperature sensor 35*d* becomes constant. The opening and closing device 17*a* is closed, and the opening and closing device 17*b* is open.

Next, the flow of the heat medium in the heat medium circuit B will be described.

In heating-use air release operation mode, the heating energy of the heat source-side refrigerant is transferred to the heat medium in both the heat exchangers related to heat medium 15*a* and the heat exchangers related to heat medium 15*b*, and the heated heat medium is caused to flow within the heat medium pipe 5 by the pump 21*a* and the pump 21*b*. The heat medium pressurized by and exiting the pump 21*a* and the pump 21*b* enters the use-side heat exchanger 26*a* via the second heat medium flow switching device 23*a*, and rejects heat to the indoor air in the use-side heat exchanger 26*a*.

Thereafter, the heat medium exits the use-side heat exchanger 26*a* and enters the heat medium flow control device 25*a*. At this time, the heat medium has its flow rate controlled by the function of the heat medium flow control device 25*a* to a flow rate required to provide the air conditioning load that is required indoors, and enters the use-side heat exchanger 26*a*. The heat medium that has exited the heat medium flow control device 25*a* enters the heat exchangers related to heat medium 15 via the first heat medium flow switching device 22*a*, and is sucked into the pump 21 again.

In the heat medium pipe 5, the heat medium flows in such a direction that the heat medium reaches the first heat medium flow switching devices 22 from the second heat medium flow switching devices 23 via the heat medium flow control devices 25. The first heat medium flow switching devices 22 and the second heat medium flow switching devices 23 are controlled to such an opening degree that secures a flow path for all of the four heat exchangers related to heat medium 15, and causes the heat medium to flow at a flow rate corresponding to the amount of heat exchange.

In heating-use air release operation mode, the air release devices 27 are opened, and thus a part of the heat medium is released from the air release devices 27 to the outside of the heat medium circuit B. Moreover, the same amount (volume) of heat medium as the amount of heat medium caused to exit by opening the opening and closing device 28 is supplied into the heat medium circuit B via the heat medium supply pipe 38.

That is, by executing the heating-use air release operation mode, air within the heat medium circuit B moves to an upper part of the pipe while circulating within the heat medium circuit B. Then, the air that has moved to the upper part of the pipe is released from the heat medium circuit B when passing the air release devices 27. At this time, in some cases, the heat medium is also released from the air release devices 27 together with air. Accordingly, the opening and closing device 28 is opened, and an amount of heat medium equivalent to the sum of the amounts of air and the heat medium that has exited together with air is supplied into the heat medium circuit B via the heat medium supply pipe 38.

By executing this heating-use air release operation mode, the solubility of air in the heat medium decreases as the heat medium is heated. If the heat medium is water, raising the heat medium from 10 degrees C. to 30 degrees C. causes the solubility to decrease from 0.0295 g/L to 0.0210 g/L. For example, when the pipe length of the heat medium pipe 5 is 60 m on one side, the pipe size (diameter) is 19.05 mm, and the pipe thickness is 1 mm, the total amount of water that is present within the heat medium pipe 5 is 27.4 kg. At this time, by raising 27.4 kg of water from 10 degrees C. to 30 degrees C., the amount of dissolved air that can be present in the heat medium pipe 5 decreases from 0.81 g to 0.58 g. That is, as the water is heated from 10 degrees C. to 30 degrees C., the amount of air that can be dissolved in water decreases by 0.23 g. The substantial 0.23 g air moves to an upper part of the pipe while circulating within the heat medium circuit B. Then, the air that has moved to an upper part of the pipe is released from the heat medium circuit B when passing the air release devices 27. When air is released from the air release devices 27, water is also released together with air in some cases. However, because the opening and closing device 28 is open, an amount of air equal to the amount of released air is supplied from the heat medium supply pipe 38 so that the amount of water within the heat medium circuit B is kept constant.

[Heating-Main-Operation-Use Air Release Operation]

A heating-main-operation-use air release operation mode is a method in which, by performing a heating main operation, air remaining in the vicinity of the use-side heat exchanger 26 is individually released by exploiting the difference in solubility in water. That is, by executing a heating-main-operation-use air release operation, air remaining in the vicinity of the use-side heat exchangers 26 can be individually released with high efficiency.

The heating-main-operation-use air release operation mode starts when the user manually inputs. Alternatively, the heating-main-operation-use air release operation mode may be started by automatically opening the opening and closing device 28 and the air release devices 27 during cooling and heating mixed operation.

Further, in heating-main-operation-use air release operation mode, in a case where the temperature detected by the indoor temperature sensor 40 is not less than a predetermined value, a heating main operation may be performed automatically for a predetermined time while the opening and closing device 28 and the air release devices 27 are opened. In this case, upon determining that the temperature detected by the indoor temperature sensor 40 is not less than a predetermined value, the controller opens the opening and closing device 28 and the air release devices 27 and performs a heating main operation, and the operation is continued for a predetermined time while keeping the temperature of the heat medium higher than a predetermined value.

The predetermined value related to the detected temperature mentioned above corresponds to the predetermined value in heating-use air release operation mode, and may be set to, for example, substantially 30 degrees C. The value of the predetermined time mentioned above is not particularly limited. Further, in a case where a heating load is generated only in the use-side heat exchanger 26*a*, for example, the temperature detected by the indoor temperature sensor 40*a* is adopted.

Figure 4:
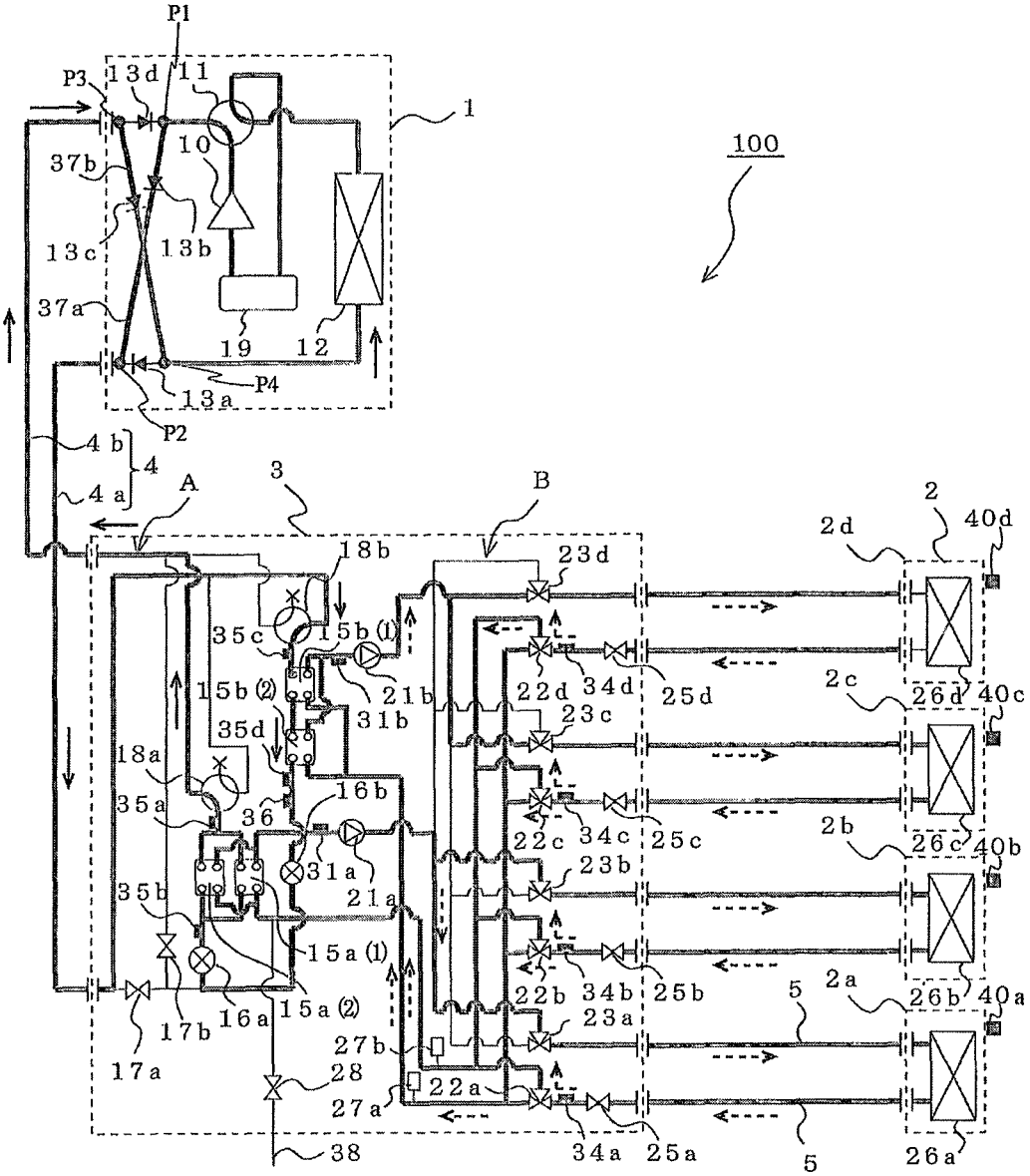
FIG. 4 is a refrigerant circuit diagram illustrating the flow of refrigerant in a heating-main-operation-use air release operation of the air-conditioning apparatus illustrated in FIG. 2.

FIG. 4 is a refrigerant circuit diagram illustrating the flow of refrigerant in heating-main-operation-use air release operation mode of the air-conditioning apparatus 100. In FIG. 4, the heating-main-operation-use air release operation mode will be described with respect to a case where a cooling load is generated in the use-side heat exchangers 26*a* and 26*b*, and a heating load is generated in the use-side heat exchangers 26*c* and 26*d*. In FIG. 4, pipes indicated by thick lines represent pipes through which the refrigerant (the heat source-side refrigerant and the heat medium) flows. In FIG. 4, the flow direction of the heat source-side refrigerant is indicated by solid arrows, and the flow direction of the heat medium is indicated by broken arrows.

First, the flow of the heat source-side refrigerant in the refrigerant circuit A will be described.

A low-temperature/low-pressure refrigerant is compressed by the compressor 10, and discharged as a high-temperature/high-pressure gas refrigerant. The high-temperature/high-pressure gas refrigerant discharged from the compressor 10 exits the outdoor unit 1 via the first refrigerant flow switching device 11 and the connection pipe 37*a*. The high-temperature/high-pressure gas refrigerant that has exited the outdoor unit 1 enters the heat medium relay unit 3 via the refrigerant pipe 4*a*. The high-temperature/high-pressure gas refrigerant that has entered the heat medium relay unit 3 is branched off, and enters the heat exchanger related to heat medium 15*b*(1) via the second refrigerant flow switching device 18*b*, and thereafter enters the heat exchanger related to heat medium 15*b*(2).

The high-temperature/high-pressure gas refrigerant that has entered the heat exchangers related to heat medium 15*b* condenses and liquefies while rejecting heat to the heat medium circulating through the heat medium circuit B, and turns into a high-pressure liquid refrigerant. The liquid refrigerant that has exited the heat exchangers related to heat medium 15*b* is expanded in the expansion device 16, and turns into a low-temperature/low-pressure two-phase refrigerant. This two-phase refrigerant enters the heat exchangers related to heat medium 15*a* that function as an evaporator.

Then, the refrigerant that has entered the heat exchanger related to heat medium 15*a* turns into a low-temperature/low-pressure two-phase refrigerant. This two-phase refrigerant enters the heat source-side heat exchanger 12 via the second refrigerant flow switching device 18*a*, the refrigerant pipe 4*b*, and the connection pipe 37*b*. The refrigerant removes heat from the outdoor air in the heat source-side heat exchanger 12, and turns into a low-temperature/low-pressure gas refrigerant. The low-temperature/low-pressure gas refrigerant that has exited the heat source-side heat exchanger 12 is sucked into the compressor 10 again via the first refrigerant flow switching device 11 and the accumulator 19.

At this time, the opening degree of the expansion device 16*a* is controlled so that the superheat obtained as the difference between the temperature detected by the third temperature sensor 35*a* and the temperature detected by the third temperature sensor 35*b* becomes constant. The expansion device 16*b* is open. Both of the opening and closing devices 17 are closed.

Next, the flow of the heat medium in the heat medium circuit B will be described.

The cooling energy of the heat source-side refrigerant and the heating energy of the heat source-side refrigerant are transferred to the heat medium in the heat exchangers related to heat medium 15*a* and the heat exchangers related to heat medium 15*b*, respectively, and the heat medium flows within the heat medium pipe 5 by the pump 21*a* and the pump 21*b*. The cooling energy due to the heat medium pressurized by and exiting the pump 21*a* enters only the use-side heat exchanger 26*a* and the use-side heat exchanger 26*b* via the second heat medium flow switching device 23*a* and the second heat medium flow switching device 23*b*, respectively. Then, the cooling energy exchanges heat with the indoor air in the use-side heat exchanger 26*a* and the use-side heat exchanger 26*b*. The heating energy due to the heat medium pressurized by and exiting the pump 21*b* enters only the use-side heat exchanger 26*c* and the use-side heat exchanger 26*d* via the second heat medium flow switching device 23*c* and the second heat medium flow switching device 23*d*, respectively. Then, the heating energy exchanges heat with the indoor air in the use-side heat exchanger 26*c* and the use-side heat exchanger 26*d*.

The heat medium that has exited the use-side heat exchanger 26*a* enters the first heat medium flow switching device 22*a* via the heat medium flow control device 25*a*. The heat medium that has exited the use-side heat exchanger 26*b* enters the first heat medium flow switching device 22*b* via the heat medium flow control device 25*b*.

The heat medium that has exited the use-side heat exchanger 26*c* enters the first heat medium flow switching device 22*c* via the heat medium flow control device 25*c*. The heat medium that has exited the use-side heat exchanger 26*d* enters the first heat medium flow switching device 22*d* via the heat medium flow control device 25*d*.

By setting the opening degrees of all of the four first heat medium flow switching devices 22 to half open, the heat medium that has exited the use-side heat exchangers 26 is branched off so as to move toward both of the heat exchangers related to heat medium 15*a* and the heat exchangers related to heat medium 15*b* from the first heat medium flow switching devices 22. At this time, a heated heat medium and a cooled heat medium have been mixed.

The heat medium that has entered the heat exchangers related to heat medium 15 is sucked into the pump 21 again. At this time, the heat medium flow control devices 25 may be fully open, or the heat medium may have its flow rate controlled to a flow rate required to provide the air conditioning load that is required indoors, and enter the use-side heat exchangers 26.

In the heating-main-operation air release operation mode, by setting the opening degrees of all of the four first heat medium flow switching devices 22 to half open, the temperature of a low-temperature heat medium that has entered the use-side heat exchanger 26*a* and the use-side heat exchanger 26*b* is expected to rise. This is because by setting the opening degrees of all of the four first heat medium flow switching devices 22 to half open, a low-temperature heat medium that has entered the use-side heat exchanger 26*a* and the use-side heat exchanger 26*b*, and a high-temperature heat medium that has entered the use-side heat exchanger 26*c* and the use-side heat exchanger 26*d* are mixed.

For example, supposing that the temperature of the heat medium that has exited the use-side heat exchanger 26*a* and the use-side heat exchanger 26*b* is 10 degrees C., the temperature of the heat medium that has exited the use-side heat exchanger 26*c* and the use-side heat exchanger 26*d* is 30 degrees C. and, further, the flow rates of the heat media are equal, the heat medium temperature after merging becomes 20 degrees C. If the heat medium is water, the solubility of air in the use-side heat exchanger 26*a* and the use-side heat exchanger 26*b* is 0.0295 g/L, the solubility of air in the use-side heat exchanger 26*c* and the use-side heat exchanger 26*d* is 0.0172 g/L, and the solubility of air after mixing (after merging) is 0.0210 g/L.

At this time, supposing that the pump 21*a* and the pump 21*b* are each sending water at 30 L/min, the amount of dissolved air in the heat medium flowing in the use-side heat exchanger 26*a* and the use-side heat exchanger 26*b* in one minute is 0.0295×30=0.885 g, and the amount of dissolved air in the heat medium flowing in the use-side heat exchanger 26*c* and the use-side heat exchanger 26*d* in one minute is 0.0172×30=0.516 g. That is, by calculation, it is determined that 0.885+0.516=1.401 g of dissolved air flows through the use-side heat exchangers 26 per minute before mixing (before merging).

The amount of dissolved air in the heat medium flowing in one minute after mixing (after merging) is 0.0210×30×2=1.260 g. Therefore, it follows that the difference between before and after mixing (before and after merging), that is, 1.401−1.260=0.141 g of air can be released from within the heat medium circuit B every minute.

By reversing the load generated in the use-side heat exchangers 26 after releasing air remaining in the vicinity of the use-side heat exchanger 26*a* and the use-side heat exchanger 26*b*, it is possible to release air for the use-side heat exchanger 26*c* and the use-side heat exchanger 26*d* as well. It means the inlet port for the heat medium from the heat exchangers related to heat medium 15 to the use-side heat exchangers 26 (connection of the second heat medium flow switching device 23) is to be switched so that the use-side heat exchangers 26*c* and 26*d* previously adapted to a heating operation is adapted to a cooling operation, and the use-side heat exchangers 26*a* and 26*b* previously adapted to a cooling operation is adapted to a heating operation.

Then, a heated heat medium is supplied to the use-side heat exchanger 26*a* and the use-side heat exchanger 26*b*, and a cooled heat medium is supplied to the use-side heat exchanger 26*c* and the use-side heat exchanger 26*d*. Therefore, air remaining in the vicinity of the use-side heat exchanger 26*a* and the use-side heat exchanger 26*b* can be released.

[Pump-Starting/Stopping Air Release Operation]

A pump-starting/stopping air release operation is an operation that promotes floating-up of air by repeating starting/stopping of the pump 21 while a heating-use air release operation or heating-main-operation-use air release operation is executed, thereby releasing air to the outside of the heat medium circuit B. At this time, the two pumps 21 may be started/stopped simultaneously, or may be started/stopped individually. In the case of starting/stopping the two pumps 21 individually, the opening degree of the first heat medium flow switching device 22 may be adjusted so as to provide connection to only the pump 21 that is being operated, or may be half open. The starting/stopping of the pumps 21 is performed by, for example, stopping the pump 21 once every several tens of seconds.

Figure 5:
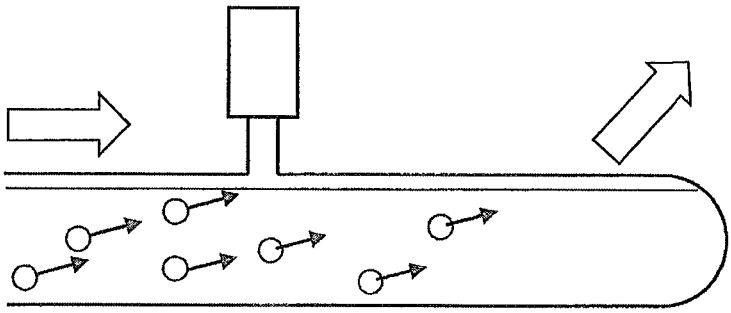
FIG. 5 illustrates the flow of air within a heat medium in the vicinity of an air release device in a pump-starting/stopping air release operation of the air-conditioning apparatus according to Embodiment of the present invention.
Figure 5:
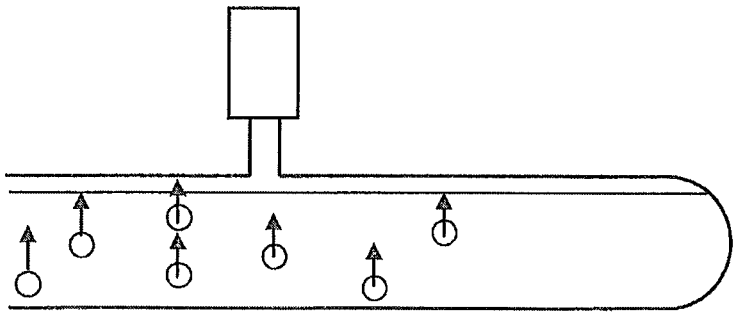

FIG. 5 illustrates the flow of air within the heat medium in the vicinity of the air release devices 27 in pump-starting/stopping air release operation of the air-conditioning apparatus 100 according to Embodiment of the present invention. FIG. 5(*a*) illustrates the flow of air when the pumps 21 are being operated, and FIG. 5(*b*) illustrates a state in which air moves upward when the pumps 21 are being stopped.

In a case where the heat medium is water, because air (air) is light in comparison to water, the air floats up in the heat medium pipe 5, and is released when passing the air release devices 27. However, in a case where the flow velocity of the heat medium is high, air tends to pass the air release devices 27 before entering the air release devices 27. That is, in a case where the flow velocity of the heat medium is high, air is less likely to be released from the air release devices 27.

Accordingly, by stopping the pumps 21 for a predetermined time, all of the air, including the air that has previously passed the air release devices 27, moves only upward. Therefore, it is possible to move more air to the air release devices 27 in a short time. That is, by performing the pump-starting/stopping air release operation, air can be released from the heat medium circuit B with high efficiency.

The operations of the heating-use air release operation mode, heating-main-operation-use air release operation mode, and pump-starting/stopping air release operation mode for releasing the air from the heat medium circuit B have been described above. In the following, the operations of various devices in each operation mode for heating or cooling the air-conditioned space 7 (see FIG. 1) will be described.

Since the heating only operation mode is the same as the flows of the heat source-side refrigerant and heat medium in heating-use air release operation mode, and the heating main operation mode is the same as the flows of the heat source-side refrigerant and heat medium in heating-main-operation-use air release operation mode, descriptions of these modes are omitted.

[Cooling Only Operation Mode]

Figure 6:
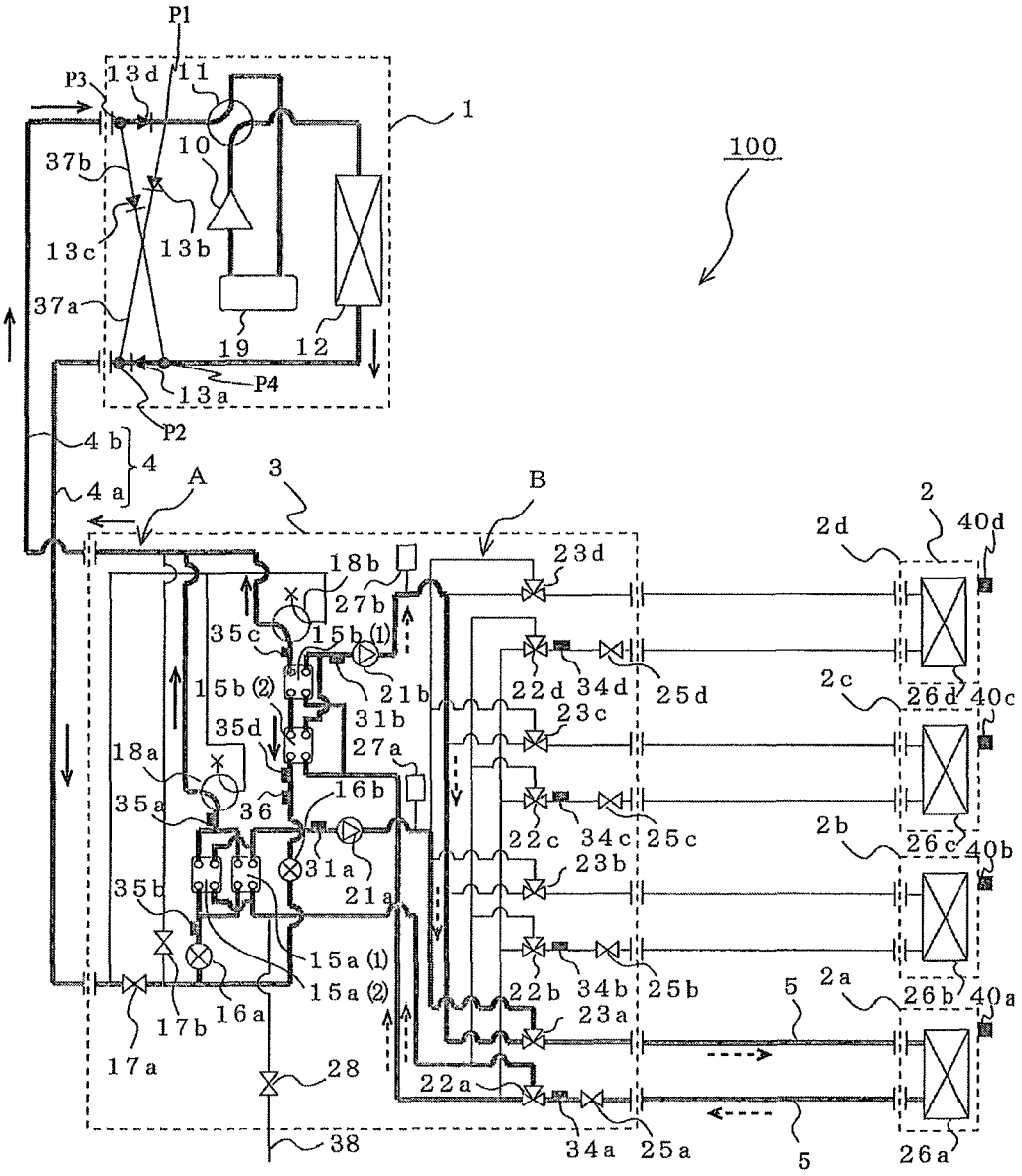
FIG. 6 is a refrigerant circuit diagram illustrating the flow of refrigerant in a cooling only operation of the air-conditioning apparatus illustrated in FIG. 2.

FIG. 6 is a refrigerant circuit diagram illustrating the flow of refrigerant in cooling only operation of the air-conditioning apparatus 100 illustrated in FIG. 2. In FIG. 6, the cooling only operation mode will be described with respect to a case where a cooling load is generated only in the use-side heat exchanger 26*a* by way of example. In FIG. 6, pipes indicated by thick lines represent pipes through which the refrigerant (the heat source-side refrigerant and the heat medium) flows. In FIG. 6, the flow direction of the heat source-side refrigerant is indicated by solid arrows, and the flow direction of the heat medium is indicated by broken arrows.

In the case of the cooling only operation mode illustrated in FIG. 6, in the outdoor unit 1, the first refrigerant flow switching device 11 is switched so as to cause the heat source-side refrigerant discharged from the compressor 10 to enter the heat source-side heat exchanger 12. In the heat medium relay unit 3, the pump 21*a* and the pump 21*b* are driven, the heat medium flow control device 25*a* is opened, the heat medium flow control devices 25*b* to 25*d* are fully closed, so that the heat medium circulates between the heat exchangers related to heat medium 15*a* and the use-side heat exchanger 26*a*. The opening and closing device 17*b* is closed.

The air conditioning load required in the indoor space 7 (see FIG. 1) can be provided by controlling to keep the difference between the temperature detected by the first temperature sensor 31*a* or the temperature detected by the first temperature sensor 31*b*, and the temperature detected by the second temperature sensor 34 to a target value. As the outlet temperature of the heat exchangers related to heat medium 15, the temperature of either the first temperature sensor 31*a* or the second temperature sensor 31*b* may be used, or the average temperature of these sensors may be used.

While the use-side heat exchanger 26*a* should normally be controlled on the basis of the temperature difference between its inlet and outlet, the heat medium temperature on the inlet side of the use-side heat exchanger 26*a* is almost the same temperature as the temperature detected by the first temperature sensor 31*b*. Accordingly, by using the first temperature sensor 31*b*, the number of temperature sensors can be reduced, and the system can be configured inexpensively.

[Cooling Main Operation Mode]

Figure 7:
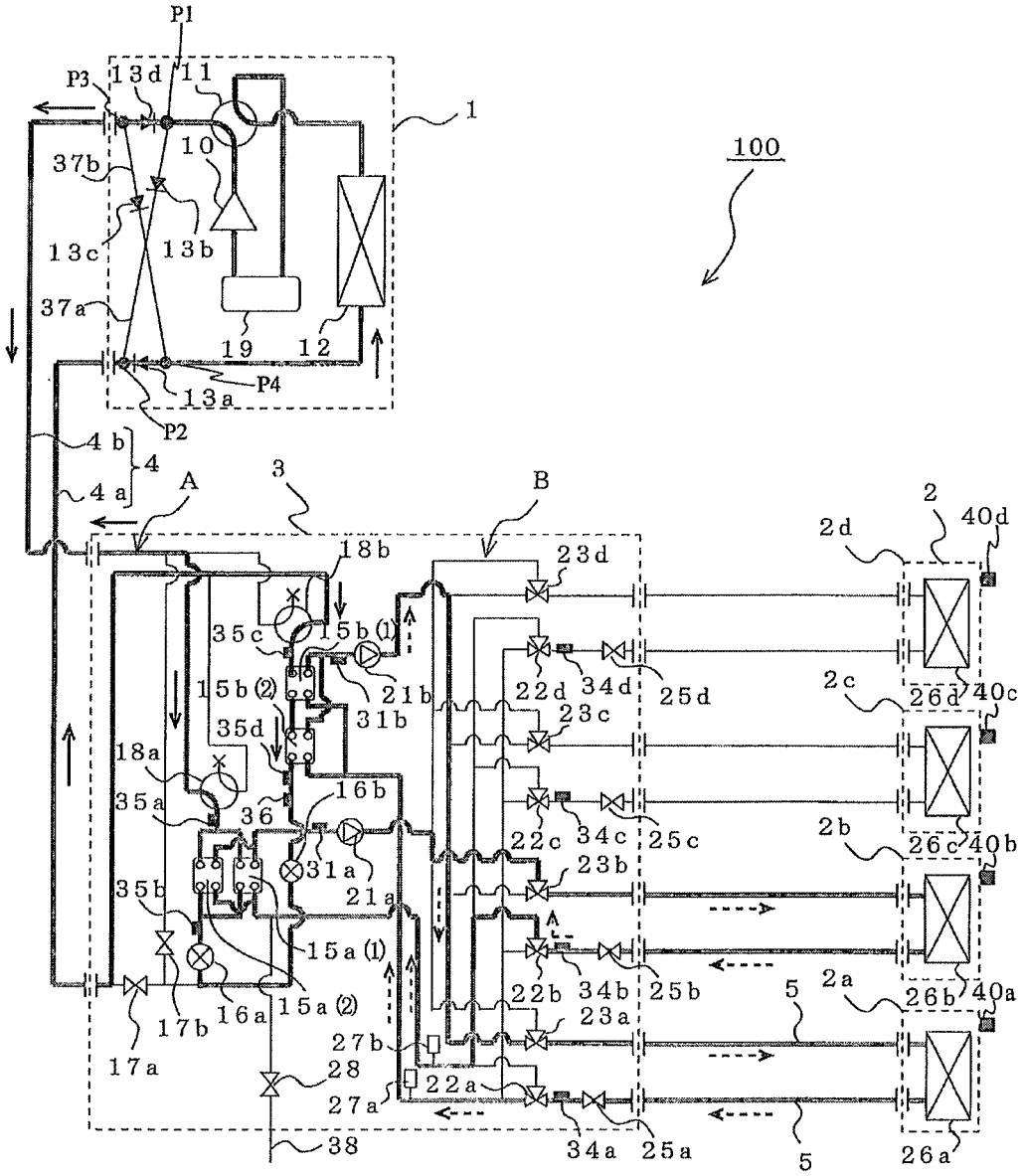
FIG. 7 is a refrigerant circuit diagram illustrating the flow of refrigerant in a cooling main operation of the air-conditioning apparatus illustrated in FIG. 2.

FIG. 7 is a refrigerant circuit diagram illustrating the flow of refrigerant in cooling main operation of the air-conditioning apparatus illustrated in FIG. 2. In FIG. 7, the cooling main operation mode will be described with respect to a case where a cooling load is generated in the use-side heat exchanger 26*a* and a heating load is generated in the use-side heat exchanger 26*b* by way of example. In FIG. 7, pipes indicated by thick lines represent pipes through which the refrigerant (the heat source-side refrigerant and the heat medium) flows. In FIG. 7, the flow direction of the heat source-side refrigerant is indicated by solid arrows, and the flow direction of the heat medium is indicated by broken arrows.

In the case of the cooling main operation mode illustrated in FIG. 7, in the outdoor unit 1, the first refrigerant flow switching device 11 is switched so as to cause the heat source-side refrigerant discharged from the compressor 10 to enter the heat source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed, so that the heat medium circulates between the heat exchangers related to heat medium 15*a* and the use-side heat exchanger 26*a*, and between the heat exchangers related to heat medium 15*b* and the use-side heat exchanger 26*b*. The opening and closing device 17 is closed.

Figure 8:
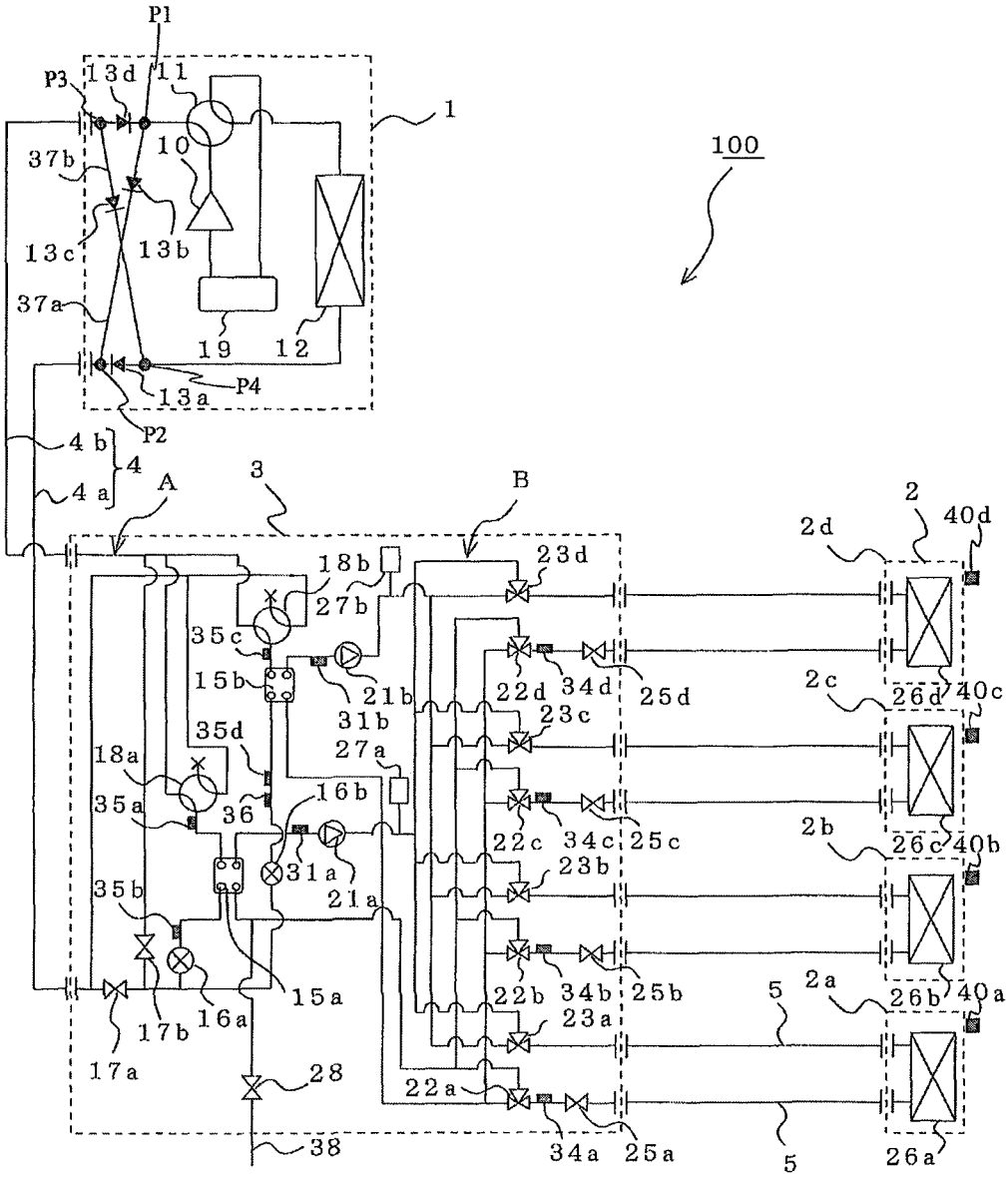
FIG. 8 illustrates another refrigerant circuit configuration example of the air-conditioning apparatus according to Embodiment of the present invention.

FIG. 8 illustrates another refrigerant circuit configuration example of the air-conditioning apparatus according to Embodiment of the present invention. While two heat exchangers related to heat medium 15*a* and two heat exchangers related to heat medium 15*b* are installed in FIGS. 2 to 4, 6, and 7, a single heat exchanger related to heat medium 15*a* and a single heat exchanger related to heat medium 15*b* are installed in FIG. 8. It is needless to mention that in the air-conditioning apparatus 100 illustrated in FIG. 8 as well, the above-mentioned operation modes can be executed, and the present invention can be applied.

The invention claimed is:

1. An air-conditioning apparatus comprising:

a refrigerant circuit having a compressor, a refrigerant flow switching valve, a heat exchanger related to a heat transfer medium, an expansion valve, and a heat source-side heat exchanger, which are connected by a refrigerant pipe to form a refrigeration cycle;

a heat transfer medium circuit having the heat exchanger related to the heat transfer medium, a pump, and a plurality of use-side heat exchangers, which are connected by a heat transfer medium pipe;

a heat transfer medium supply pipe connected to the heat transfer medium circuit to supply the heat transfer medium;

an opening and closing valve provided to the heat transfer medium supply pipe;

an air release valve provided in the heat transfer medium pipe, and configured to release air remaining within the heat transfer medium supply pipe; and a controller configured to control the refrigerant flow switching valve, the pump, the opening and closing valve, and the air release valve, wherein the controller is configured to perform a first heating operation in which the heat source-side heat exchanger functions as an evaporator and the heat exchanger related to heat transfer medium functions as a radiator and the pump operates, and a second heating operation while releasing air in which the controller performs the first heating operation and controls both the opening and closing valve and the air release valve to be opened.

2. The air-conditioning apparatus of claim 1, wherein operation and stopping of the pump are continuously repeated.

3. The air-conditioning apparatus of claim 1, further comprising:

an indoor temperature sensor that detects a temperature in an air-conditioned space;

wherein in a case where the detected temperature is less than a predetermined value, the controller performs the second heating operation with releasing air.

4. The air-conditioning apparatus of claim 1, wherein the air release valve is always open during the heating operation.

5. The air-conditioning apparatus of claim 1, wherein the heat transfer medium supply pipe is connected directly to the heat transfer medium pipe.

6. The air-conditioning apparatus of claim 1, wherein the controller is configured to perform a cooling operation in which the heat source-side heat exchanger functions as a radiator and the heat exchanger related to the heat transfer medium functions as an evaporator and the pump operates, and switch the refrigerant flow switching valve to a first position to perform the heating operation and the heating operation with releasing air and to a second position to perform the cooling operation, a discharge side of the compressor being connected to the heat exchanger related to the heat transfer medium and a suction side of the compressor being connected to the heat source-side heat exchanger when the refrigerant flow switching valve is switched to the first position, and the suction side of the compressor being connected to the heat exchanger related to the heat transfer medium and the discharge side of the compressor being connected to the heat source-side heat exchanger when the refrigerant flow switching valve is switched to the second position.

7. An air-conditioning apparatus comprising:

a refrigerant circuit having a compressor, a first refrigerant flow switching valve, a plurality of second refrigerant flow switching valves, a plurality of heat exchangers related to a heat transfer medium, a plurality of expansion valves, and a heat source-side heat exchanger, which are connected by a refrigerant pipe to form a refrigeration cycle;

a first opening and closing valve provided in the refrigerant pipe;

a second opening and closing valve provided in the refrigerant pipe;

a heat transfer medium circuit having the heat exchangers related to the heat transfer medium, a pump, a plurality of first heat transfer medium flow switching valves, a plurality of second heat transfer medium flow switching valves and a plurality of use-side heat exchangers, which are connected by a heat transfer medium pipe;

a heat transfer medium supply pipe connected to the heat transfer medium circuit to supply the heat transfer medium;

a third opening and closing valve provided in the heat transfer medium supply pipe;

a plurality of air release valves provided in the heat transfer medium pipe, and configured to release air remaining within the heat transfer medium supply pipe; and a controller configured to control the first refrigerant flow switching valve, the second refrigerant flow switching valves, the pump, the first opening and closing valve, the second opening and closing valve, the third opening and closing valve, the first heat transfer medium flow switching valves, the second heat transfer medium flow switching valves, and the air release valves, wherein the refrigerant pipe includes a first pipe having first and second ends, and provided with the second opening and closing valve, a second pipe having a first end connected to the first refrigerant flow switching valve or the heat source-side heat exchanger and a second end connected to the second refrigerant flow switching valves and the first end of the first pipe, a third pipe having a first end connected to the heat source-side heat exchanger or the first refrigerant flow switching valve and a second end connected to the expansion valves and the second end of the first pipe, and provided with the first opening and closing valve, and a fourth pipe having a first end connected to a first flow path of the third pipe, the first flow path being positioned downstream of the first opening and closing valve, and a second end connected to the second refrigerant flow switching valves, wherein the second end of the first pipe is connected to a second flow path of the third pipe between the first opening and closing valve and the expansion valves, wherein the second end of the second pipe and the second end of the fourth pipe are connected to the second refrigerant flow switching valves, respectively, wherein the second end of the third pipe is connected to the expansion valves in parallel, wherein the heat exchanger related to the heat transfer medium is connected between the second refrigerant flow switching valve and the expansion valve, wherein the first heat transfer medium flow switching valve includes a first inlet connected to the use-side heat exchangers and a plurality of first outlets connected to the heat exchangers related to the heat transfer medium, wherein the second heat transfer medium flow switching valve includes a plurality of second inlets connected to the heat exchangers related to the heat transfer medium and a second outlet connected to the use-side heat exchangers, wherein the air release valves are provided to third flow paths of the heat transfer medium pipe, the third flow paths being connected between the first heat transfer medium flow switching valves and the second heat transfer medium flow switching valves, wherein the controller is configured to perform a cooling operation in which the heat source-side heat exchanger functions as a radiator and the heat exchangers related to the heat transfer medium function as evaporators and the pump operates, a first heating operation in which the heat source-side heat exchanger functions as an evaporator and the heat exchangers related to the heat transfer medium function as a radiators and the pump operates, and a first cooling and heating mixed operation in which the heat source-side heat exchanger functions as the radiator or the evaporator and one or more of the heat exchangers related to the heat transfer medium function as the evaporator and the rest of the heat exchangers related to the heat transfer medium function as the radiator and the pump operates, a second heating operation with releasing air in which the controller performs the first heating operation and controls both the third opening and closing valve and the air release valves to be opened, and a second cooling and heating mixed operation with releasing air in which the controller performs the first cooling and heating mixed operation and controls both the third opening and closing valve and the air release valves to be opened.

8. The air-conditioning apparatus of claim 7, further comprising:

an indoor temperature sensor that detects a temperature in an air-conditioned space;

wherein in a case where the detected temperature is less than a predetermined value, the controller performs the second heating operation with releasing air, and in a case where the detected temperature is not less than the predetermined value, the controller performs the second cooling and heating mixed operation with releasing air.

9. The air-conditioning apparatus of claim 7, wherein operation and stopping of the pump are continuously repeated.

10. The air-conditioning apparatus of claim 7, wherein the air release valve is always open during the heating only operation.

11. The air-conditioning apparatus of claim 7, wherein during the heating operation with releasing air, the controller opens all of the first outlets.

12. The air-conditioning apparatus of claim 7, wherein the controller is configured to switch the first refrigerant flow switching valve between a first position and a second position, a discharge side of the compressor being connected to the third pipe and a suction side of the compressor being connected to the heat source-side heat exchanger when the first refrigerant flow switching valve is switched to the first position, the discharge side of the compressor being connected to the heat exchangers related to the heat transfer medium and the suction side of the compressor being connected to the second pipe when the first refrigerant flow switching valve is switched to the second position, and switch the second refrigerant flow switching valves between a third position and a fourth position, the fourth pipe being connected to the heat exchangers related to the heat transfer medium when the second refrigerant flow switching valves are switched to the third position, the second pipe being connected to the heat exchangers related to the heat transfer medium when the second refrigerant flow switching valves are switched to the fourth position, wherein, during the first heating operation and the second heating operation with releasing air, the first refrigerant flow switching valve is switched to the first position, the second refrigerant flow switching valves are switched to the third position, the first opening and closing valve is closed, and the second opening and closing valve is opened, wherein, during the cooling operation, the first refrigerant flow switching valve is switched to the second position, the second refrigerant flow switching valves are switched to the fourth position, the first opening and closing valve is opened, and the second opening and closing valve is closed, and wherein, during the first cooling and heating mixed operation and the second cooling and heating mixed operation with releasing air, the first refrigerant flow switching valve is switched to the first position, one or more the second refrigerant flow switching valve is switched to the third position and the rest of the second refrigerant flow switching valve is switched to the fourth position, the first opening and closing valve and the second opening and closing valve are closed.

* * * * *